US011060262B2

(12) United States Patent
Vigholm et al.

(10) Patent No.: US 11,060,262 B2
(45) Date of Patent: Jul. 13, 2021

(54) DRIVE SYSTEM FOR A WORKING MACHINE AND A METHOD FOR CONTROLLING THE DRIVE SYSTEM

(71) Applicant: Volvo Construction Equipment AB, Eskilstuna (SE)

(72) Inventors: Bo Vigholm, Stora Sundby (SE); Karl Uebel, Kvicksund (SE)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 16/766,099

(22) PCT Filed: Nov. 23, 2017

(86) PCT No.: PCT/EP2017/080188
§ 371 (c)(1),
(2) Date: May 21, 2020

(87) PCT Pub. No.: WO2019/101313
PCT Pub. Date: May 31, 2019

(65) Prior Publication Data

US 2020/0354927 A1 Nov. 12, 2020

(51) Int. Cl.
*F15B 7/00* (2006.01)
*E02F 9/22* (2006.01)
*E02F 3/28* (2006.01)

(52) U.S. Cl.
CPC ..... *E02F 9/2253* (2013.01); *E02F 9/2225* (2013.01); *E02F 9/2232* (2013.01); *F15B 7/008* (2013.01); *E02F 3/283* (2013.01)

(58) Field of Classification Search
CPC ..... E02F 9/2253; E02F 9/2225; E02F 9/2232; E02F 9/226; F15B 37/008
See application file for complete search history.

(56) References Cited

U.S. PATENT DOCUMENTS 8,302,720 B2 11/2012 Rose et al.
2004/0003782 A1 1/2004 Ziplies et al.
2009/0036270 A1* 2/2009 Hayashi ..... E02F 9/225 477/181

FOREIGN PATENT DOCUMENTS

DE 9012312 U1 1/1991
JP 2013209940 A 10/2013
(Continued)

OTHER PUBLICATIONS

International Search Report and Written Opinion of the International Searching Authority, PCT/EP2017/080188 dated Jul. 27, 2018, 12 pages.

*Primary Examiner* — Abiy Teka
*Assistant Examiner* — Daniel S Collins
(74) *Attorney, Agent, or Firm* — Sage Patent Group

(57) ABSTRACT

The invention relates to a drive system for a working machine, the drive system including: a gearbox; an internal combustion engine having an engine output shaft; a power takeoff coupled to the engine output shaft; a torque converter having an input shaft operatively coupled to the engine and an output shaft operatively coupled to the gearbox; a hydraulic cooling fan; a hydraulic fan pump coupled to the power takeoff and connected to the hydraulic fan via a first hydraulic valve. The drive system further includes: a hydraulic motor coupled to the gearbox and configured to provide power to the gearbox for vehicle propulsion, wherein the hydraulic motor is coupled to the hydraulic fan pump via a second hydraulic valve and arranged to receive power from the hydraulic fan pump. The invention further relates a method for controlling the described drive system.

20 Claims, 4 Drawing Sheets

(56) References Cited

FOREIGN PATENT DOCUMENTS

| | | | |
|---|---|---|---|
| KR | 100988406 | B1 | 10/2010 |
| WO | 2007043924 | A1 | 4/2007 |
| WO | 2008041891 | A1 | 4/2008 |

* cited by examiner

DRIVE SYSTEM FOR A WORKING MACHINE AND A METHOD FOR CONTROLLING THE DRIVE SYSTEM

CROSS REFERENCE TO RELATED APPLICATIONS

This application is a 35 U.S.C. § 371 national stage application of PCT International Application No. PCT/EP2017/080188 filed on Nov. 23, 2017, the disclosure and content of which is incorporated by reference herein in its entirety.

TECHNICAL FIELD

The invention relates to a drive system and a method for controlling a drive system of a working machine. In particular, the method and system relates to a drive system comprising an internal combustion engine and a torque converter.

The invention is applicable on working machines within the fields of industrial construction machines or construction equipment, in particular wheel loaders. Although the invention will be described with respect to a wheel loader, the invention is not restricted to this particular machine, but may also be used in other working machines such as articulated haulers, excavators and backhoe loaders.

BACKGROUND

In connection with transportation of heavy loads, e.g. in construction work, work machines are frequently used. A work machine may be operated with large and heavy loads in areas where there are no roads, for example for transports in connection with road or tunnel building, sand pits, mines and similar environments.

A work machine is often used in a repeated work cycle. The term "work cycle" comprises a route of the work machine (i.e. the work cycle travel path) and a movement of a work implement, such as a bucket, (lifting/lowering operation). The work cycle is repeated in the same geographical area. During the performance of the work cycle, the work machine often encounters different gradients of the ground (uphill and downhill), and turns (cornering).

To improve the fuel efficiency of the working machine, a hybrid drive system comprising an energy storage system can be used. The energy storage system can be charged when excess energy is available during a work cycle, for example during braking by producing the required braking torque with the pump/motor and charging the accumulators with pressurized oil. The energy can then later on be reused.

It is for example possible to employ an electric hybrid system where the energy storage is a battery or an accumulator. However, the electric components needed for hybrid machines may be expensive, making an investment in an electrical hybrid system difficult to recover only through short term fuel savings. An alternative is to use a hydraulic hybrid system consisting of a pump/motor attached to the gearbox and a hydraulic energy storage system based on hydraulic accumulators and control valves.

U.S. Pat. No. 8,302,720 describes an energy storage system for a hybrid vehicle comprising an energy storage system including a reservoir containing working fluid and a first and second reversible pump/motor. However, the energy storage system described by U.S. Pat. No. 8,302,720 is rather complex and would require substantial additions to currently existing drive systems for heavy vehicles.

Accordingly, it is still desirable to provide an improved drive system and a method for controlling a drive system in a working machine providing improved fuel efficiency.

SUMMARY

An object of the invention is to provide a drive system for a working machine and a method for controlling the drive system where the drive system comprises a torque converter operatively coupled between the combustion engine and the gearbox The object is achieved by a drive system according to claim 1.

According to a first aspect of the invention, there is provided a drive system for a working machine comprising: a gearbox; an internal combustion engine having an engine output shaft; a power takeoff coupled to the engine output shaft; a torque converter having an input shaft operatively coupled to the engine and an output shaft operatively coupled to the gearbox; a hydraulic cooling fan; a hydraulic fan pump coupled to the power takeoff and connected to the hydraulic fan via a first hydraulic valve. The drive system further comprises: a hydraulic motor coupled to the gearbox and configured to provide power to the gearbox for vehicle propulsion, wherein the hydraulic motor is coupled to the hydraulic fan pump via a second hydraulic valve and arranged to receive power from the hydraulic fan pump.

The present invention is based on the realization that a hydraulic motor can be arranged and configured to receive power from a hydraulic fan pump which typically already exists in a working machine. The hydraulic fan pump is part of a cooling system further comprising the hydraulically driven fan which is arranged to cool the combustion engine. Thereby, the described system offers a simple and easy solution for increasing the power efficiency of a working machine since the system to a large degree comprises of components commonly pre-existing in a working machine, and only minor additions and modifications are required.

Accordingly, the described system is a low cost add-on hydraulic hybrid system with substantial potential for fuel savings that does not require major modifications to the hardware in presently available wheel loaders and other working machines. The main fuel savings potential lies in the reduction of torque converter power losses. In particular, with the described system, the torque converter can be supported by the hydraulic motor to avoid operating points with high power losses. Energy losses in the torque converter are proportional to the torque converter slip, i.e. the difference in rotational speed of the input shaft and output shaft of the torque converter. Accordingly, it is desirable to minimize the power provided from the combustion engine for vehicle propulsion during operations where a high torque converter slip is required.

According to one embodiment, the drive system may further comprise a control unit configured to: determine an efficiency of the torque converter; and if the determined efficiency of the torque converter is below a predetermined threshold value, close the first hydraulic valve and open the second hydraulic valve such that the hydraulic pump provides a hydraulic flow to the hydraulic motor. The efficiency of the torque converter can be determined by determining the energy losses in the torque converter which are proportional to the torque converter slip, i.e. the difference in rotational speed of the input shaft and output shaft of the torque converter. Accordingly, it is desirable to minimize the power provided from the combustion engine for vehicle propulsion during operations with high torque converter slip. When it is determined that the torque converter efficiency is below a predetermined threshold value, the hydraulic motor is activated by redirecting a flow of hydraulic fluid from the hydraulic fan pump such that the hydraulic fan is disconnected and the hydraulic motor provides power for vehicle propulsion via the gearbox.

According to a further embodiment, the control unit may be configured to control the hydraulic pump to provide a hydraulic flow to the hydraulic motor based on a requested torque to be provided from the hydraulic motor to the gearbox. In the drive system as a whole, the engine control logic, here embodied by the control unit, determines a torque to be provided to the vehicle drive shaft based on a request from the operator of the vehicle. The required torque in turn controls the combustion engine which, via the torque converter, provides the required power for vehicle propulsion. As discussed above, there are certain operating conditions where the torque converter operates with low efficiency. For example, an action where a working machine drives a bucket into a heap of material, which may be referred to as a bucket fill action, is an action where a high torque is typically required for vehicle propulsion while the vehicle speed is relatively low. Accordingly, a high torque converter slip can be expected and it is thereby desirable to provide as much power as possible from the hydraulic motor to minimize losses in the torque converter. Here, the power provided by the hydraulic motor to the gearbox, i.e. the torque provided to an input shaft of the gearbox, is in turn translated into a torque applied to the drive shaft of the vehicle based on a known relationship. Accordingly, the output torque provided by the hydraulic motor should be adapted to the total required torque for vehicle propulsion. If the requested torque for vehicle propulsion exceeds the maximum available torque from the hydraulic motor, the remaining torque may be provided by the hydraulic motor. In principle, the maximum possible torque should be provided from the hydraulic motor to maximize the energy efficiency improvement. This in turn means that the hydraulic fan pump should operate at maximum power, the first hydraulic valve is fully closed and the second hydraulic valve is fully open. Thereby, it may be possible to reduce the torque provided by the combustion engine by reducing the engine speed.

According to one embodiment, the control unit may be further configured to control the hydraulic flow from the hydraulic pump by controlling a fan control signal. Accordingly, since the relation between the pressure from the hydraulic fan pump and the fan speed can be assumed to be known, a fan control signal, requesting a specific fan speed, can be used to achieve a specific pressure from the hydraulic fan pump which in turn translates to a specific known torque from the hydraulic motor to the gearbox.

According to one embodiment, the hydraulic pump may be pressure controlled via an electrical control signal from a fan controller. Thus, existing control circuitry and control functionality for the hydraulic fan pump can be utilized in the described system.

According to one embodiment, the first and second hydraulic valves may advantageously be on-off valves. An advantage of using hydraulic on-off valves is that they are both simple in construction and can be provided at a relatively low cost compared to many other types of valves.

According to one embodiment the hydraulic motor may advantageously be a fixed displacement motor such that the torque provided by the motor is determined by the pressure of the hydraulic fluid provided by the hydraulic fan pump. A fixed displacement motor is both cost effective and has a relatively simple construction, thereby minimizing the cost and complexity of the system.

According to one embodiment of the invention, the hydraulic motor may be configured to rotate in a forward direction when the vehicle is moving forward, and to rotate in a backward direction when the vehicle is reversing. This provides for a straightforward coupling of the motor to the gearbox where an output shaft of the motor is permanently coupled to an input shaft of the gearbox.

According to one embodiment, the drive system may further comprise a third hydraulic valve arranged between an output and an input of the hydraulic motor, wherein the third hydraulic valve is configured to be open when the second hydraulic valve is closed and to be closed when the second hydraulic valve is open. This means that the third hydraulic valve is open when the motor is not receiving a flow of hydraulic fluid from the fan pump, and thus not providing a torque to the gearbox. By allowing a hydraulic flow to rotate through the motor via the third hydraulic valve when the second hydraulic valve is closed, the third hydraulic valve enables lubrication of the motor also when the motor is not used for providing power to the gearbox. Accordingly, the motor is lubricated in both driving directions and in both an active and an inactive mode.

According to one embodiment, the drive system may further comprise a pressure regulator located at the output of the hydraulic motor, the pressure regulator being configured to limit a pressure in the hydraulic motor. Thereby, the pressure regulator acts as a relief valve added at the return line which will keep a small pressure at the motor to properly lubricate the motor.

According to one embodiment of the invention the second hydraulic valve may be configured to allow a predetermined flow of hydraulic fluid through the second valve when in a closed position, wherein the flow of hydraulic fluid through the second valve when the valve is closed is smaller than a flow of hydraulic fluid through the second valve when the valve is open. Thereby, the motor can receive a sufficient amount of hydraulic fluid to be lubricated also when the motor is not used to provide a torque to the gearbox, i.e. when the second valve is in a closed position and where a main portion of the pressure provided by the hydraulic fan pump goes to the hydraulic fan. The second hydraulic valve may preferably be an electrically controlled on/off valve.

According to one embodiment of the invention, the flow of hydraulic fluid through the second hydraulic valve when the valve is closed may be in the range of 1-5 litres/min and a flow of hydraulic fluid through the second hydraulic valve when the valve is open may be in the range of 30-70 litres/min. Accordingly, the flow through the valve when in a closed position is comparatively small and only for lubricating the motor, and is substantially smaller than an example flow through the second hydraulic valve when open.

There is also provided a vehicle comprising a drive system according to any of the above described embodiments. The described drive system may advantageously be used in any vehicle comprising a hydraulic fan system and a torque converter.

The object is further achieved by a method for controlling a drive system according to claim 14.

According to a second aspect of the invention, there is provided a method for controlling a drive system in a working machine. The drive system comprises a gearbox; an internal combustion engine having an engine output shaft; a power takeoff coupled to the engine output shaft; a torque converter having an input shaft operatively coupled to the engine and an output shaft operatively coupled to the gearbox; a hydraulic cooling fan; a hydraulic fan pump coupled to the power takeoff and connected to the hydraulic cooling fan via a first hydraulic valve; and a hydraulic motor coupled to the gearbox and configured to provide power to the gearbox for vehicle propulsion, wherein the hydraulic motor is coupled to the hydraulic fan pump via a second hydraulic valve and arranged to receive power from the hydraulic fan pump. The method comprises the steps of: determining an efficiency of the torque converter; and if the determined efficiency of the torque converter is below a predetermined threshold value, closing the first hydraulic valve and opening the second hydraulic valve such that the hydraulic fan pump provides a hydraulic flow to the hydraulic motor.

The predetermined threshold value for the torque converter slip may for example be 50%. Since the torque converter slip is defined as the difference in rotational speed of the input shaft and output shaft of the torque converter, a torque converter slip of 50% means that the output shaft of the torque converter rotates at half the speed of the input shaft of the torque converter. The relation between torque converter slip and energy losses in the torque converter can be considered to be known, and the threshold value can be set based on the known properties of the torque converter to achieve an improvement in fuel efficiency resulting from the power provided by the hydraulic fan pump.

Hereby, the described drive system can be controlled to improve the overall fuel efficiency of the drive system since the power loses in the torque converter can be reduced.

Additional effects and features of this second aspect of the present invention are largely analogous to those described above in connection with the first aspect of the invention.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

In the present detailed description, various embodiments of a drive system and a method for controlling a suspension system according to the present invention are mainly discussed with reference to a drive system in a wheel loader. It should be noted that this by no means limits the scope of the present invention which is equally applicable for other types of working machines.

Figure 1:
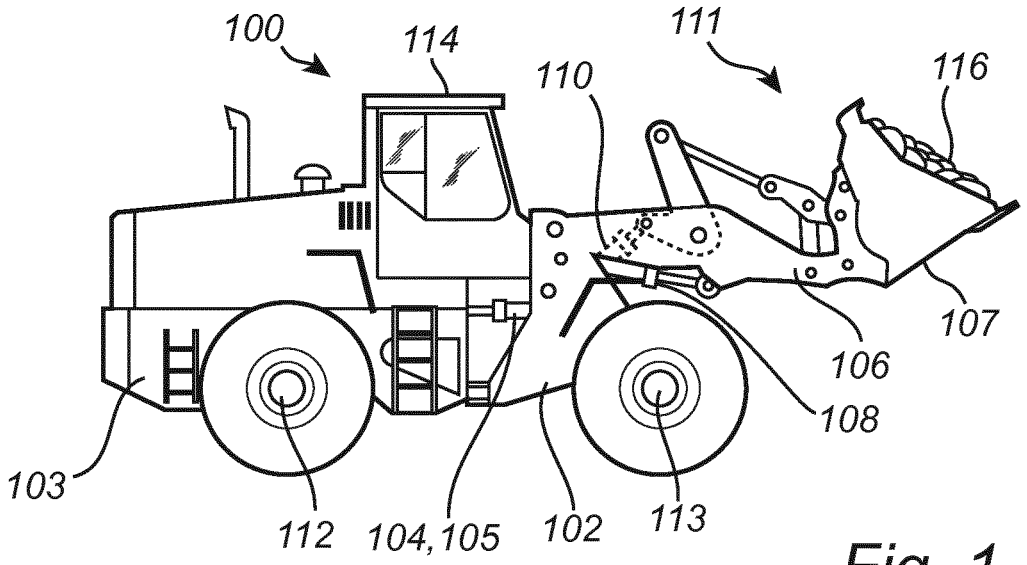
FIG. 1 is a schematic illustration of a working machine comprising a suspension system according to an embodiment of the invention.

FIG. 1 shows a frame-steered working machine in the form of a wheel loader 100. The body of the wheel loader 100 comprises a front body section 102 and a rear body section 103, which sections each comprises a pair of wheels 112, 113. The rear body-section 103 comprises a cab 114. The body sections 102, 103 are connected to each other in such a way that they can pivot in relation to each other around a vertical axis by means of two first actuators in the form of hydraulic cylinders 104, 105 arranged between the two sections 102, 103. The hydraulic cylinders 104, 105 are thus arranged one on each side of a horizontal centerline of the vehicle in a vehicle traveling direction in order to turn the wheel loader 101.

The wheel loader 100 comprises equipment 111 for handling a load 116 such as objects or material. The equipment 111 comprises a load-arm unit 106, also referred to as a linkage, and an implement 107 in the form of a bucket fitted on the load-arm unit 106. A first end of the load-arm unit 106 is pivotally connected to the front vehicle section 102. The implement 107 is pivotally connected to a second end of the load-arm unit 106.

The load-arm unit 106 can be raised and lowered relative to the front section 102 of the vehicle by means of actuators in the form of one or more hydraulic cylinders 108, connected at one end to the front vehicle section 102 and at the other end to the load-arm unit 106. The bucket 107 can be tilted relative to the load-arm unit 106 by means of an actuator in the form of a hydraulic cylinder 110, which is connected at one end to the front vehicle section 102 and at the other end to the bucket 107 via a link-arm system 115.

Figure 2:
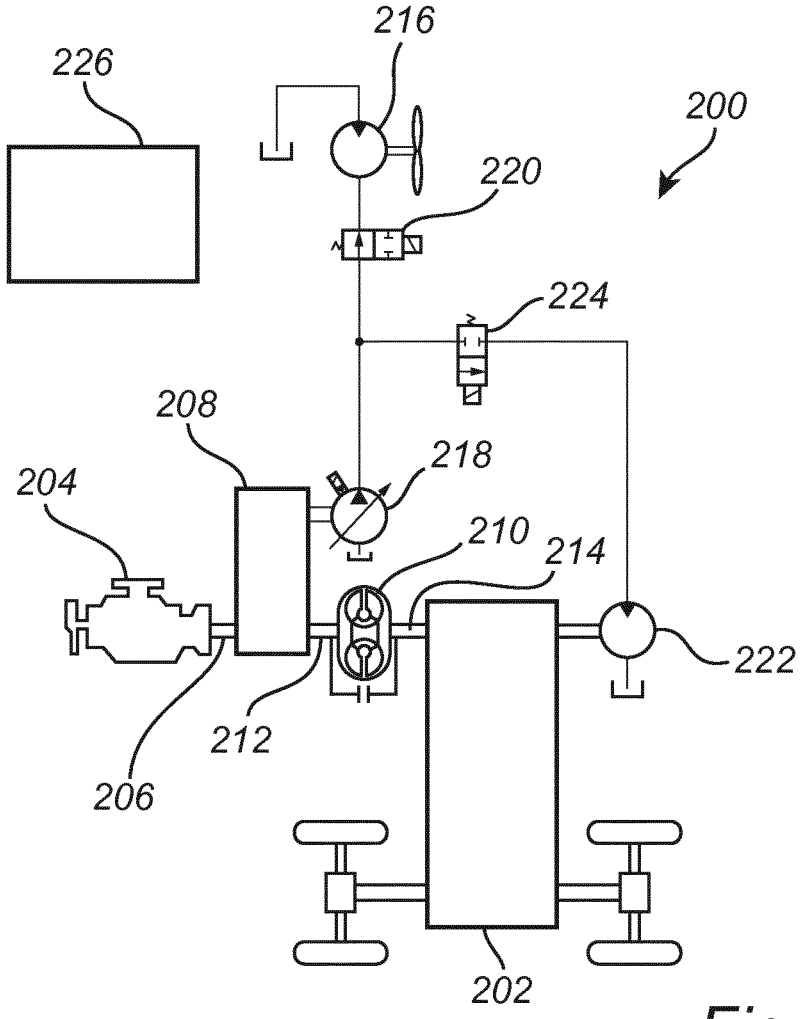
FIG. 2 is a schematic illustration of a drive system for working machine according to an embodiment of the invention.

FIG. 2 schematically illustrates a drive system 200 according to an embodiment of the invention. The drive system 200 may advantageously be equipped in the working machine 100 illustrated in FIG. 1. The drive system comprises: a gearbox 202, an internal combustion engine 204 having an engine output shaft 206 connecting the engine 204 to a power takeoff (PTO) 208. The power takeoff 208 is arranged to use an output torque from the combustion engine 204 to provide power to one or more hydraulic systems, as will be described in further detail in the following. The drive system 200 further comprises a torque converter 210 having an input shaft 212 operatively coupled to the engine 204 and an output shaft 214 operatively coupled to the gearbox 202. In the currently illustrated embodiment, the input shaft 212 of the torque converter 210 is connected to the engine 204 via the power takeoff 208 and the output shaft 214 of the torque converter 210 is directly connected to the gearbox 202. The working machine 100 can be considered to comprise additional hydraulic systems powered by the engine 204, e.g. hydraulic systems used for steering or for operating a linkage and an implement of the working machine. However, such additional hydraulic systems are well known and will not be discussed in further detail herein.

Moreover, the drive system comprises a hydraulic cooling fan 216 and a hydraulic fan pump 218 coupled to the power takeoff 208 and connected to the hydraulic cooling fan 216 via a first hydraulic valve 220. The hydraulic cooling fan 216 is arranged to cool the engine 204 and possibly also other parts of the working machine 100. The hydraulic cooling fan 216 is driven by the hydraulic fan pump 218 which in turn is driven by the engine 204 via the power takeoff 208. The rotational speed of the hydraulic cooling fan 216 depends on the pump pressure provided from the hydraulic fan pump 218, and the pump pressure is controlled by a control unit 226 that provides an electric control signal to the hydraulic fan pump 218.

The control unit 226 may include a microprocessor, microcontroller, programmable digital signal processor or another programmable device. The control unit 226 may also, or instead, include an application specific integrated circuit, a programmable gate array or programmable array logic, a programmable logic device, or a digital signal processor. Where the control unit 226 includes a programmable device such as the microprocessor, microcontroller or programmable digital signal processor mentioned above, the processor may further include computer executable code that controls operation of the programmable device.

The control unit 226 is connected to the various described features of the drive system 200 and is configured to control at least parts of the drive system 200. Moreover, the control unit 226 may be embodied by one or more control units, where each control unit may be either a general purpose control unit or a dedicated control unit for performing a specific function.

The drive system further comprises a hydraulic motor 222 coupled to the gearbox 202 and configured to provide power to the gearbox 202 for vehicle propulsion, wherein the hydraulic motor 222 is coupled to the hydraulic fan pump 218 via a second hydraulic valve 224 and arranged to receive power from the hydraulic fan pump 218. In particular, the hydraulic motor 222 is arranged to receive power exclusively from the hydraulic fan pump 218.

It should be noted that both the hydraulic fan pump 218 and the hydraulic motor 222 in principle may be provided in the form of hydraulic machines capable of operation both as a pump and as a motor. However, in order to minimize the complexity of the drive system 200, the hydraulic fan pump 218 is advantageously an electric pressure controlled variable pump, and the hydraulic motor 222 is preferably a fixed displacement motor.

Figure 3:
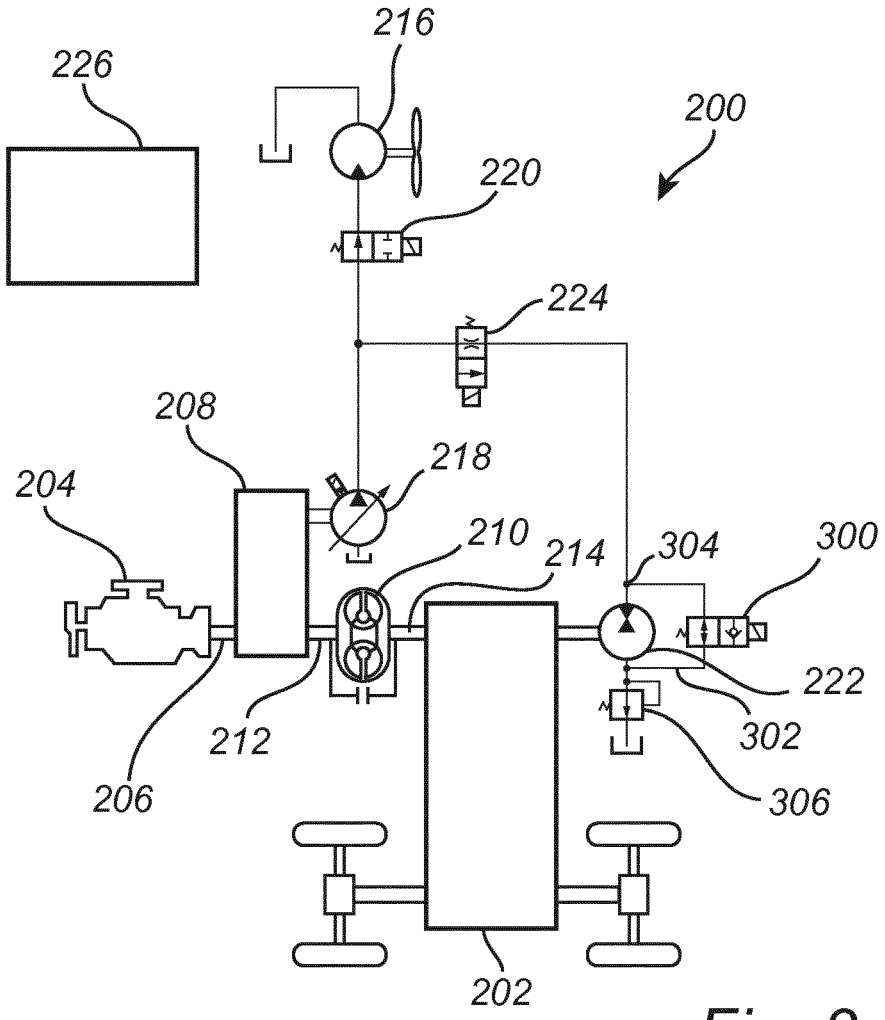
FIG. 3 is a schematic illustration of a drive system for a working machine according to an embodiment of the invention.

FIG. 3 schematically illustrates an embodiment of the drive system further comprising a third hydraulic valve 300 arranged between an output 302 and an input 304 of the hydraulic motor 222, wherein the third hydraulic valve 300 is configured to be open when the second hydraulic valve 224 is closed and to be closed when the second hydraulic valve 224 is open, thereby enabling a lubricating flow of hydraulic fluid through the hydraulic motor 222 also when the motor 222 is not used for providing a torque to the gearbox 202, i.e. when the second hydraulic valve 224 is closed.

The drive system of FIG. 3 further comprises a pressure regulator 306 located at the output 302 of the hydraulic motor 222 and configured to maintain and limit a pressure in the hydraulic motor 222. In an active mode where the second hydraulic valve 224 is open and the hydraulic fan pump 218 is running to provide a flow to the motor 222, the pressure at the input of the motor 222 is high, e.g. in the range of 100 bar, while the pressure at the motor output 302 is significantly lower.

Efficient lubrication of the motor 222 is achieved by maintaining a certain pressure in the motor 222 and by circulating the hydraulic fluid via the open third hydraulic valve 300. The pressure can be achieved by means of the pressure regulator 306. The pressure regulator 306 may for example be set to open at a pressure of a few bars, such as 3 bar. The second hydraulic valve 224 is configured such that when in a closed mode, there is still a small opening in the valve 224 allowing a small flow of hydraulic fluid facilitating lubrication of the motor 222.

In a system where an existing hydraulic cooling fan 216 is pressure controlled by a variable hydraulic fan pump 218 having the pressure control functionality required to propel the fan motor 216 at the required speed, the described hydraulic motor 222 and valve 224 and can be added as a simple add-on system, providing improved fuel efficiency to the drive system.

The amount of torque added by the hydraulic motor 222 to the gearbox 202 can be controlled to reduce the power losses occurring in the torque converter 210, i.e. by activating the hydraulic motor 222 when the torque converter 210 operates at low efficiency.

Figure 4:
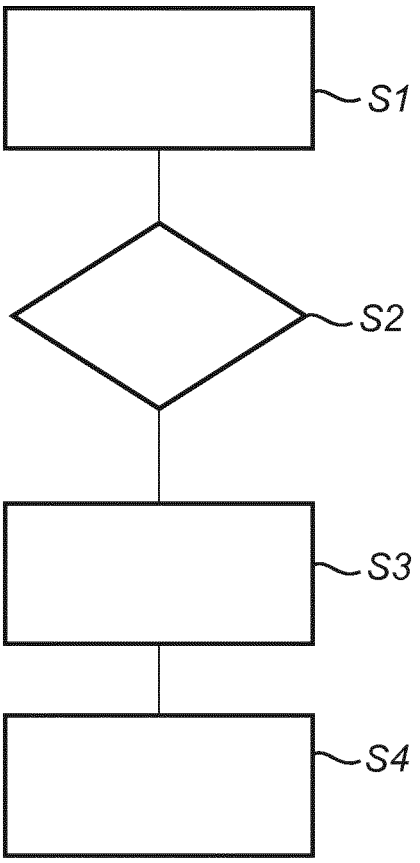
FIG. 4 is a flow chart outlining the general steps of controlling a drive system for a working machine according to an embodiment of the invention, and FIG. 5 comprises graphs illustrating features of a method and a system according to embodiment of the invention.

FIG. 4 is a flow chart outlining the general steps of a method for controlling the drive system, 200. The method can be assumed to be performed by the control unit 226 and comprises the steps of: determining S1 an efficiency of the torque converter 210; and if S2 the determined efficiency of the torque converter 210 is below a predetermined threshold value, closing S3 the first hydraulic valve 220 and opening S4 the second hydraulic valve 224 such that the hydraulic fan pump 218 provides a hydraulic flow, i.e. a hydraulic pressure, to the hydraulic motor 222, resulting in a torque provided to the gearbox 202, where the torque is used for vehicle propulsion. The hydraulic pressure provided by the hydraulic fan pump 218 can be set by means of controlling the fan control signal provided to the hydraulic fan pump 218. The relation between the pressure from the hydraulic fan pump 218 and the resulting torque output by the hydraulic motor 222 can be considered to be known. Accordingly the cooling fan 216 is shut down during the periods where the first hydraulic valve 220 is closed, the second hydraulic valve 224 is opened, and the hydraulic motor 222 is activated. However, the duration of the activation of the hydraulic motor 222 can be controlled to be sufficiently short so that the temporary loss of cooling does not have any harmful effects.

The torque converter 210 typically operates at low efficiency when a high torque is required for vehicle propulsion, such as when a wheel loader drives forward to push the bucket into a pile of material. The described system is primarily intended to be used in one driving direction where the main fuel savings can be made, e.g. during the described wheel loader bucket filling operation. However, it should be noted that the described system may be used to an advantage in both driving directions with only minor modifications.

Figure 5:
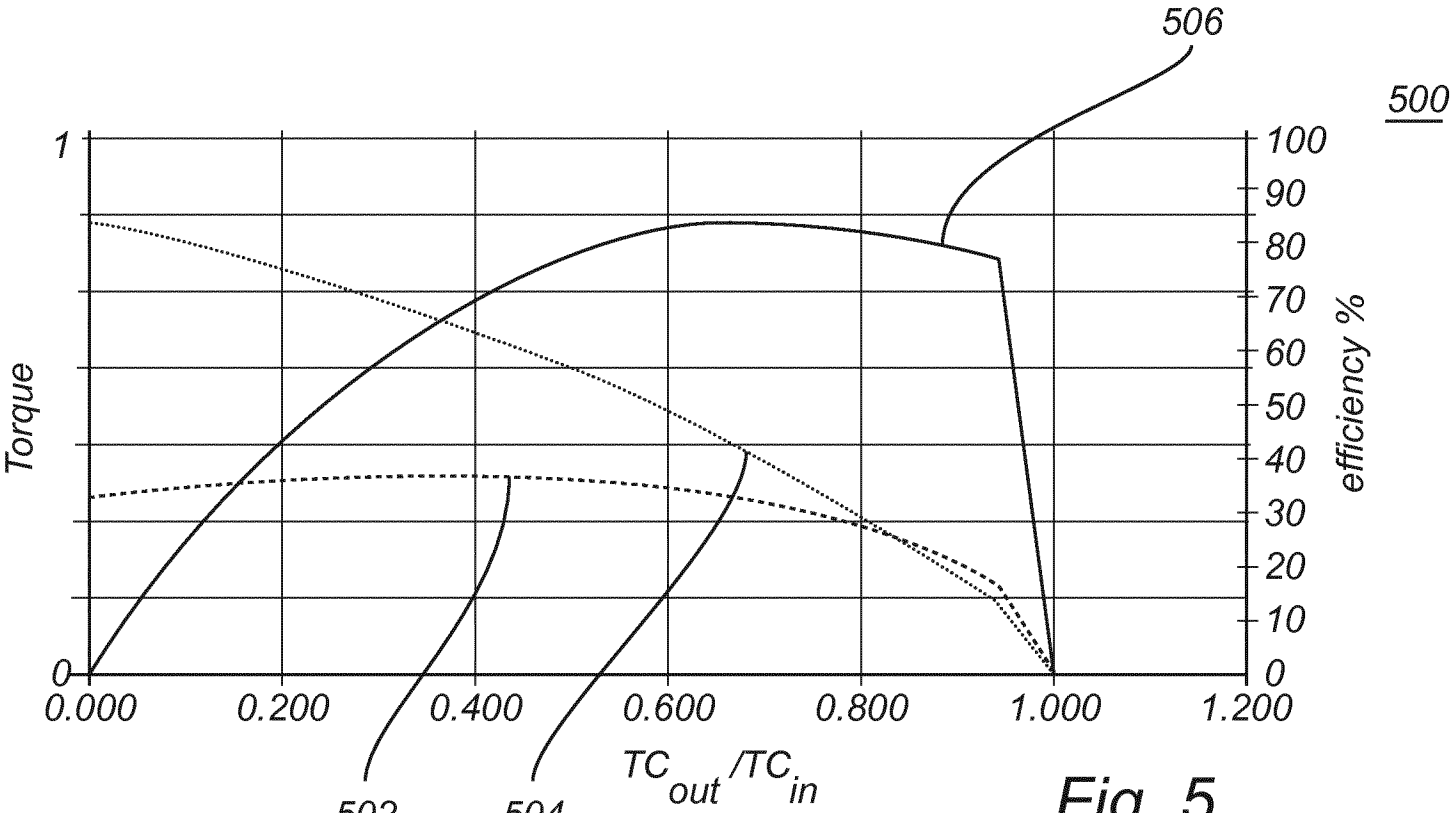

FIG. 5 is a graph 500 outlining the performance of the torque converter 210 as a function of the torque converter slip, $TC_{out}/TC_{in}$, where $TC_{in}$, is the rotational speed of the input shaft 212 and $TC_{out}$ is the rotational speed of the output shaft 214 of the torque converter 210. Accordingly, for $TC_{out}/TC_{in}=0$, the output shaft 214 of the torque converter 210 is not moving and for $TC_{out}/TC_{in}=1$ the input shaft 212 and output shaft 214 rotates with the same speed.

Curve 502 illustrates the torque on the input shaft 212 of the torque converter 210, which is the torque provided from the combustion engine 204 via the power takeoff 208. Curve 504 illustrates the output torque of the torque converter 210 and curve 506 schematically illustrates the efficiency of the torque converter 210. It can be assumed that the above described relations are known or that they can be approximated to be used in the described methods for controlling the drive system.

For a high torque converter slip, i.e. where $TC_{out}/TC_{in}$ is close to zero, the output torque 504 from the torque converter 210 at its maximum and the efficiency of the torque converter 210 is very low and it is thereby advantageous to provide power from the hydraulic motor 222 to reduce energy losses in the torque converter 210 during such times when the torque converter 210 operates with low efficiency.

It is to be understood that the present invention is not limited to the embodiments described above and illustrated in the drawings; rather, the skilled person will recognize that many changes and modifications may be made within the scope of the appended claims.

The invention claimed is:

1. A drive system for a working machine, the drive system comprising:

a gearbox;

an internal combustion engine having an engine output shaft;

a power takeoff coupled to the engine output shaft;

a torque converter having an input shaft operatively coupled to the engine and an output shaft operatively coupled to the gearbox;

a hydraulic cooling fan;

a hydraulic fan pump coupled to the power takeoff and connected to the hydraulic fan via a first hydraulic valve;

wherein the drive system further comprises:

a hydraulic motor coupled to the gearbox and configured to provide power to the gearbox for vehicle propulsion, wherein the hydraulic motor is coupled to the hydraulic fan pump via a second hydraulic valve and arranged to receive power from the hydraulic fan pump.

2. The drive system according to claim 1, further comprising a control unit configured to:

determine an efficiency of the torque converter; and if the determined efficiency of the torque converter is below a predetermined threshold value, close the first hydraulic valve and open the second hydraulic valve such that the hydraulic pump provides a hydraulic flow to the hydraulic motor.

3. The drive system according to claim 2, wherein the control unit is further configured to control the hydraulic pump to provide a hydraulic flow to the hydraulic motor based on a requested torque to be provided from the motor to the gearbox.

4. The drive system according to claim 2, wherein the control unit is further configured to control the hydraulic flow from the hydraulic pump by controlling a fan control signal.

5. The drive system according to claim 1, wherein the hydraulic pump is configured to be pressure controlled via an electrical control signal from a fan controller.

6. The drive system according to claim 1, wherein the first and second hydraulic valves are on-off valves.

7. The drive system according to claim 1, wherein the hydraulic motor is a fixed displacement motor.

8. The drive system according to claim 1, wherein the hydraulic motor is configured to rotate in a forward direction when the vehicle is moving forward and in a backward direction when the vehicle is reversing.

9. The drive system according to claim 1, further comprising a third hydraulic valve arranged between an output and an input of the hydraulic motor, wherein the third hydraulic valve is configured to be open when the second hydraulic valve is closed and to be closed when the second hydraulic valve is open.

10. The drive system according to claim 9, further comprising a pressure regulator located at the output of the hydraulic motor and configured to limit a pressure in the hydraulic motor.

11. The drive system according to claim 9, wherein the second hydraulic valve is configured to allow a predetermined flow of hydraulic fluid through the second hydraulic valve when in a closed position, wherein the flow of hydraulic fluid through the second hydraulic valve when closed is smaller than a flow of hydraulic fluid through the second hydraulic valve when open.

12. The drive system according to claim 11, wherein the flow of hydraulic fluid through the second valve when the valve is closed is in the range of 1-5 litres/min and a flow of hydraulic fluid through the second valve when the valve is open is in the range of 30-70 litres/min.

13. A vehicle comprising a drive system according to claim 1.

14. A method for controlling a drive system in a working machine, the drive system comprising:

a gearbox;

an internal combustion engine having an engine output shaft;

a power takeoff coupled to the engine output shaft;

a torque converter having an input shaft operatively coupled to the engine and an output shaft operatively coupled to the gearbox;

a hydraulic cooling fan;

a hydraulic fan pump coupled to the power takeoff and connected to the fan via a first hydraulic valve; and a hydraulic motor coupled to the gearbox and configured to provide power to the gearbox for vehicle propulsion, wherein the hydraulic motor is coupled to the hydraulic fan pump via a second hydraulic valve and arranged to receive power from the hydraulic fan pump;

the method further comprising:

determining an efficiency of the torque converter; and if the determined efficiency of the torque converter is below a predetermined threshold value, closing the first hydraulic valve and opening the second hydraulic valve such that the hydraulic fan pump provides a hydraulic flow to the hydraulic motor.

15. The method according to claim 14, further comprising controlling the hydraulic flow from the hydraulic pump to provide a hydraulic flow to the hydraulic motor based on a requested torque to be provided from the motor to the gearbox.

16. The method according to claim 14, further comprising determining the efficiency of the torque converter based on a torque converter slip.

17. The method according to claim 14, wherein controlling the flow from the hydraulic pump comprises controlling a fan control signal.

18. The method according to claim 14, wherein the drive system further comprises a third hydraulic valve arranged between an output and an input of the hydraulic motor, wherein the method further comprises controlling the third hydraulic valve to be open when the second hydraulic valve is closed and to be closed when the second hydraulic valve is open.

19. A computer program comprising program code for performing the method of claim 14 when the program is run on a computer.

20. A computer readable medium carrying a computer program comprising program code for performing the method of claim 14 when the program product is run on a computer.

* * * * *